US005879514A

United States Patent [19]

Meschenmoser

[11] Patent Number: 5,879,514

[45] Date of Patent: Mar. 9, 1999

[54] SCRAPER DEVICE FOR A PAPER MACHINE

[75] Inventor: Andreas Meschenmoser, Horgenzell, Germany

[73] Assignee: Voith Sulzer Papiermaschinen GmbH, Heidenheim, Germany

[21] Appl. No.: 821,342

[22] Filed: Mar. 20, 1997

[30] Foreign Application Priority Data

Mar. 21, 1996 [DE] Germany ..... 196 11 166.8

[51] Int. Cl.[6] ..... D21F 7/04

[52] U.S. Cl. ..... 162/272; 162/274; 162/199; 15/256.5; 15/256.51

[58] Field of Search ..... 162/272, 274, 162/275, 281, 282, 199; 15/156.5, 156.51

[56] References Cited

U.S. PATENT DOCUMENTS 5,021,124 6/1991 Turtinen et al. ..... 162/99
5,240,563 8/1993 Karvinen et al. ..... 162/274
5,393,383 2/1995 Karvinen ..... 162/274
5,611,892 3/1997 Karvinen et al. ..... 162/205

FOREIGN PATENT DOCUMENTS 0117670 9/1984 European Pat. Off. .

*Primary Examiner*—Peter Chin
*Assistant Examiner*—Steven B. Leavitt
*Attorney, Agent, or Firm*—Greenblum & Bernstein, P.L.C.

[57] ABSTRACT

A scraper device for a paper machine comprises first and second scraper means that can be pivoted into engagement with a fabric web and with a guide roll, respectively. By combining at least two scraper means in a common assembly, a particularly compact and cost-saving structure is achieved. Due to the fact that the first scraper means is arranged upstream of the guide roll, viewed in the direction of travel of the fabric web, and that it can be pivoted into engagement with the fabric web from below in a manner such that a downwardly open space is left, it is guaranteed that the paper residues will be carried off completely even in case of trouble, for example in case of web failure.

35 Claims, 4 Drawing Sheets

SCRAPER DEVICE FOR A PAPER MACHINE

BACKGROUND OF THE INVENTION

The present invention relates to a scraper device for a paper machine having first scraper means that extend transversely to the direction of web travel and that can be pivoted into engagement with a fabric web guided to travel along an endless loop, and second scraper means that extend transversely to the direction of web travel and can be pivoted into engagement with a roll about which the fabric web is guided.

A scraper device of that kind is known from EP 0 117 670 A2.

The known scraper device comprises two scraper blades arranged below a guide roll about which the fabric web is guided. One of the two scraper blades engages the roll, while the other one of the two scraper blades can be pivoted into engagement with the fabric web. Both scraper blades are arranged on an upwardly open scraper beam extending transversely to the direction of web travel so that any excessive oil is removed from the roll and the fabric web by the scraper blades, and drops into and is carried off by the scraper beam.

However, the described scraper device is located within the loop formed by the endless fabric web and is, therefore, not suited for receiving fibrous residues originating from the paper web.

Paper machines use the most diverse types of felt or screen cloth for various purposes. These endless webs, having at least the width of the paper web and being mostly permeable to water, serve to dewater, guide or dry the paper web and are exposed to different kinds of soiling. On the one hand, paper fibers, fillers or chemicals tend to adhere to them, and sometimes even the paper web itself may stick to them. In addition, residual components of recycled paper used as raw material may also deposit on them. On the one hand, scrapers are employed for removing such undesirable contamination. On the other hand, the web is guided around smooth guide rolls in order to transfer the deposited dirt to the latter. This procedure protects the fabric, since direct cleaning of the fabric by means of a scraper may of course result in heavier wear.

In addition, suction tubes have been used to remove from the felt webs, by the application of a vacuum and in a careful way, any separate loose fibers, fines and chemicals that may have been transferred in a press nip to the press felt from the paper web, which latter has not yet reached a really solid condition at that time, in one operation with the removal of any water attaching to it.

At the beginning of the sheet-forming process, the paper web formed in the screen section first runs through the press section. In case only a single press felt is provided in such a wet press section for absorbing the liquid squeezed out of the paper web, the paper web, as it leaves the press nip, will stick to the smooth press roll and must be detached from it. If, however, each of the wet presses is provided with two endless press felts, the paper web guided between them tends to stick to the lower press felt so that it must be detached from the latter and directed into the next following section. At the commencement of production, and in case of interruptions, care must be taken to ensure that the paper web is not entrained, neither in its entirety nor in parts, by the press felt and carried to the suction tubes as this condition may lead to clogging of the suction tubes. Felt guide rolls that get into contact with the correspondingly soiled outer face of the felt, between the press nip and the suction tubes, remove already part of the paper residues on the felt and must, therefore, be continuously cleaned by cleaning scrapers. In case of trouble, for example if the paper web breaks, the web would stick to the first outer felt guide roll and wrap around it. Consequently, every effort is made to ensure that an entrained paper web, or parts thereof, are removed from the press felt immediately, if possible, and are returned in a controlled way into the production cycle. In addition to providing an outer felt guide roll with a scraper device and means arranged below the latter for carrying off any removed paper web residues, the felt guide roll is preceded by felt scrapers that function to scrape any paper web residues directly off the press felt. However, during normal operation of the production cycle, these scrapers are pivoted clear of the press felt so as not to cause undue wear to the press felt. But when the paper web then suddenly breaks, the felt scraper will not come into engagement in due time so that one has to rely initially on the effectiveness of the felt guide roll which is continuously cleaned by the scraper device.

The scraper device mentioned above is neither intended, nor suited, to guarantee the safe removal of any paper web residues from the felt guide roll in case the paper web should break suddenly, because the scraper device is located within the loop encircled by the endless fabric web. Even if, contrary to the described arrangement, the known device were located outside the loop, it could still not provide the desired safety in case of breakage of the paper web as in this case felt web residues from the felt guide roll and possibly from the felt would get into the scraper beam and would immediately clog the latter in case of failure of the web, with a resulting failure of the scraper function and, thus, of the felt guide roll.

SUMMARY OF THE INVENTION

It is an object of the present invention to provide a scraper device for a paper machine that overcomes the aforementioned disadvantages and allows gentle cleaning of the soiled elements, while improving at the same time the safety with which the paper web is carried off immediately and efficiently, especially in the event of malfunctions.

This object is achieved according to the invention by the fact that a scraper device of the type described above is arranged outside the loop of the endless fabric web and can be pivoted into engagement with the fabric web from below in such a way that a downwardly open space is left through which any scrap and/or paper residues removed can be carried off in downward direction under the effect of gravity.

The object of the invention is perfectly achieved in this way since in case of web failure the paper web entrained by the fabric web is detached by the first scraper means and safely carried off in downward direction through the remaining free space.

At the same time, a space-saving structure is guaranteed by the fact that a single scraper device functions to clean the felt guide roll and the press felt as well. The arrangement may be such that during normal operation only the scraper means in contact with the felt guide roll occupies its active position, while in case of trouble, for example when the paper web comes to wrap around the felt guide roll, both scraper means will be pivoted into active engagement automatically.

The fabric web may take the form of an impermeable cloth or else of a screen cloth, depending on the diverse functional groups of the paper machine.

According to a convenient further improvement of the invention, both scraper means are mounted on a common scraper beam extending transversely to the direction of web travel.

This permits a simple and compact structure of the scraper device to be achieved.

According to a further development of that embodiment of the invention, the scraper beam is stationary, whereas the first and the second scraper means can be pivoted into engagement with the elements to be cleaned.

This allows the two scraper means to function independently one from the other.

In an alternative embodiment of the invention, the scraper beam is movable, and at least one of the scraper means is movable relative to the scraper beam and to one of the elements to be cleaned.

One makes use in this case of the scraper beam itself for pressing the scraper means against an element to be cleaned, while guaranteeing at the same time the independent operation of the other scraping means by making it movable relative to the scraper beam and the element to be cleaned.

According to an additional development of that alternative, the first scraper means is rigidly mounted on the scraper beam, the latter being pivotal about a longitudinal axis extending transversely to the direction of web travel and the second scraper means being arranged to pivot about a longitudinal axis, preferably about the same longitudinal axis.

This permits the first and the second scraper means to be brought into engagement with the parts to be cleaned in a particularly simple fashion.

According to an additional further development of the invention, the first scraper means is a scraper strip intended to clean a press felt, whereas the second scraper means mostly comprises a thin, elastic blade intended to clean a guide roll provided outside the press felt.

A scraper device of that kind may be used with particular advantage at the beginning of the press section of a paper machine with the scrapers for the guide roll on the one hand, and for the press felt on the other hand, which normally are arranged independently one from the other, being combined in the scraper device according to the invention.

According to an additional further development of that embodiment, the scraper strip gets into contact with the press felt earlier than the second scraper means with the guide roll, viewed in the direction of web travel of the felt.

This guarantees a high degree of safety in case of trouble that any paper web residues, or the paper web as such, will be carried off early enough to avoid soiling of the suction tubes.

According to a further preferred development of the invention, the first scraper means is fastened on the end of the scraper beam remote from the longitudinal axis about which the scraper beam can pivot, while the second scraper means, at least its elastic blade, projects from the longitudinal axis in opposite direction.

This arrangement has the effect that when the first scraper means is pivoted into engagement with the press felt, the scraping operation of the second scraper means at the guide roll is not impaired to any considerably degree. If the paper web then fails and comes to wrap around the guide roll and if, contrary to all expectations, the elastic blade of the first scraper means should not suffice to remove the paper web completely from the guide roll, then, as the thickness of the layer on the guide roll increases, the scraper means will be pressed more closely against the press felt so that a preliminary removal of the paper web residues from the press felt will be effected by that first scraper means. This provides additional safety, independently of the capability of the second scraper means to pivot separately, that in case of trouble any paper web residues will be completely scraped off the press felt and/or the guide roll.

According to a preferred further development of the invention, the scraper strip is made from sintered ceramics or a plastic material.

Especially when made from sintered ceramics, the scraper strip thereby achieves high wear resistance.

According to still another embodiment of the invention, the second scraper means comprises a blade carrier, that can pivot about a longitudinal axis relative to the scraper beam and on which a scraper blade is mounted, and a pressure body, extending in the longitudinal direction of the scraper blade, is arranged on each side of the longitudinal axis, between the scraper beam and the blade carrier, whereby it is rendered possible to very elastically press the scraper blade against the roll, or lift it off the roll depending on the pressure exerted upon the pressure body.

This feature provides the advantage that, regardless of the movement of the scraper beam, the scraper strip is safely pressed against the guide roll and, on the other hand, lifted off the guide roll, while the structure is kept particularly simple, the fact that the pressure bodies extend over the full length of the blade carrier guaranteeing uniform contact pressure and, simultaneously, good resilience of the blade carrier.

According to an additional development of the invention, the pressure body, that faces away from the roll, is connected with an accumulator in the before-mentioned embodiment.

It is thus possible to ensure a particularly uniform contact pressure between the scraper blade and the roll, and the contact pressure remains substantially constant when the scraper beam is pivoted.

According to an additional further development of the invention, a spray pipe is provided on the scraper beam.

This enables the outside of the press felt to be wetted, so that any paper web residues can be removed from the roll by the scraper blade more easily. The spray pipe can be integrated with the scraper beam in a particularly simple and compact way.

According to an additional further development of the invention, a stationary stop is provided with which the scraper beam can be pivoted into engagement in its active position.

It is thus possible to predetermine the optimum operating position of the scraper beam by a stop. According to an advantageous further development of that embodiment, the stop is made adjustable.

According to a preferred further development of the invention, the first and the second scraper means are arranged so close together that any paper web residues scraped off can drop into common wetting and reduction means.

This results in a particularly simple structure.

According to another advantageous development of the invention, the guide roll located within the felt loop before the scraper means, viewed in the direction of web travel, is arranged in such a way that, when the paper web winds around the felt guide roll, any parts of the paper web will fall past the scraper beam and into the common wetting and reduction means.

Any paper particles falling off this preceding felt guide roll are in this case also delivered to the common wetting and reduction means directly and without any additional effort.

According to another embodiment of the invention, the guide roll arranged upstream of the first scraper means, in the direction of felt travel, is movable for the purpose of pressing the press felt against the first scraper means.

This is a simple way of pressing the first scraper means against the press felt.

According to an additional further development of the invention, automatic control means are provided for bringing the first scraper means into contact with the fabric web in case of failure of the web.

One achieves in this way a particularly high degree of operating safety, as the first scraper means, intended for scraping off any paper residues, is automatically activated in case of web failure.

The wetting and reduction means comprises, according to an advantageous further development of the invention, water jets for wetting and/or reducing the paper web residues.

This facilitates the disintegration of the paper web residues and prevents them from sticking to the collection vessel or the pulper.

According to a still further alternative of the invention, at least one of the two scraper means comprises at least two scraper units arranged for being pivoted into engagement with one and the same element for cleaning the latter.

It is possible in this way to further improve the cleaning effect by the use of two scraper means arranged one behind the other.

According to another preferred embodiment of the invention, the common scraper beam, extending transversely to the direction of web travel, is capable of performing an oscillating movement.

This provides the advantage that the formation of scraper marks on the fabric web or the guide roll is avoided.

It is understood that the use of the invention is not restricted to the press section of a paper machine, but that advantageous applications are possible also in the screen section or drying section of the paper web path.

It should further be noted that the before-mentioned features and those to be explained below can be used not only in the respective combinations indicated, but also in other combinations or in isolation, without leaving the context of the present invention.

SHORT DESCRIPTION OF THE DRAWINGS

An exemplified embodiment of the invention is depicted in the appended drawings and will be explained in more detail in the description below. In the drawings.

Figure 3:
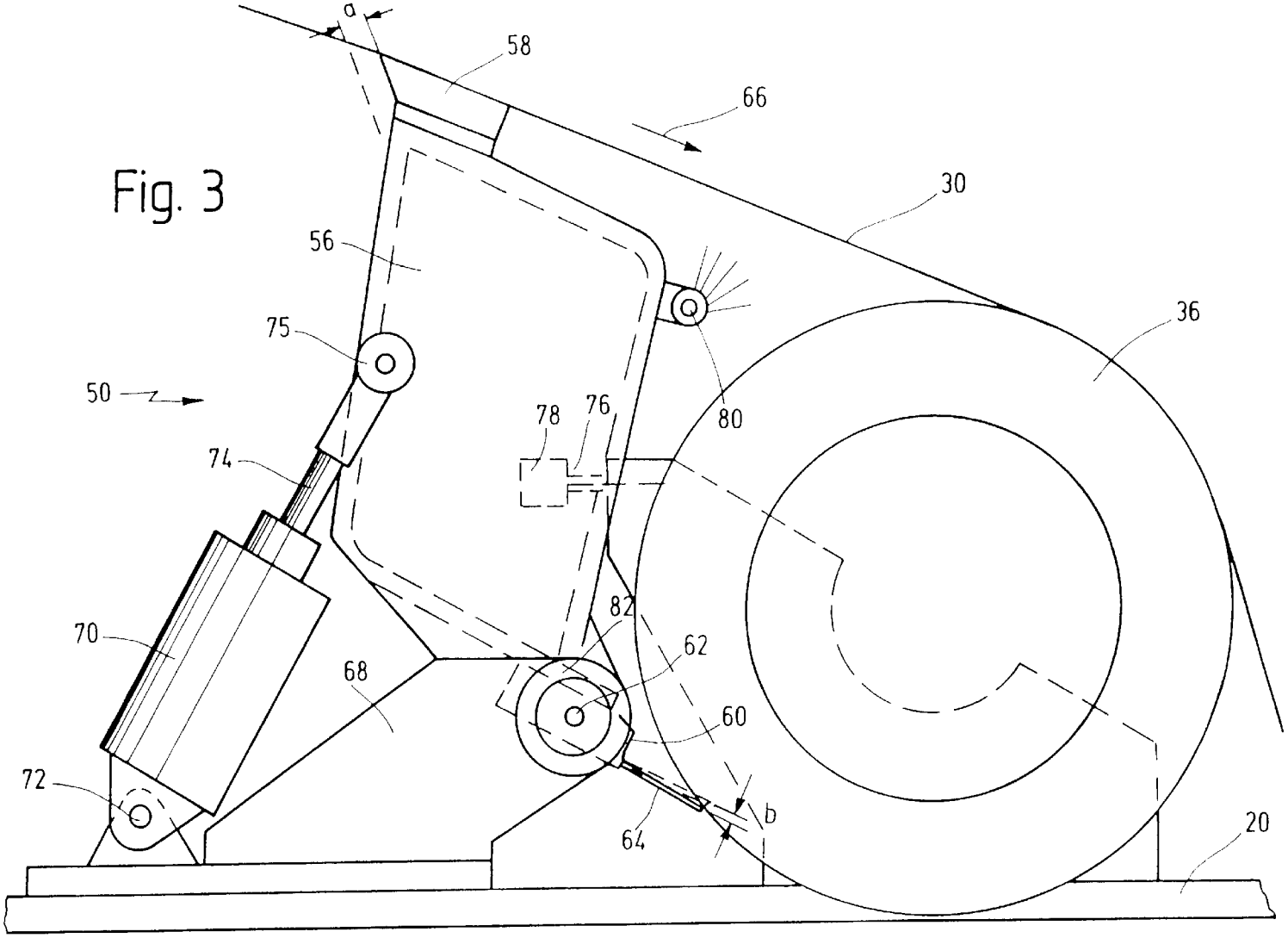
FIG. 3 shows a still further enlarged representation of a scraper device according to the invention that acts upon a guide roll on the one hand and a press felt on the other hand.
Figure 4:
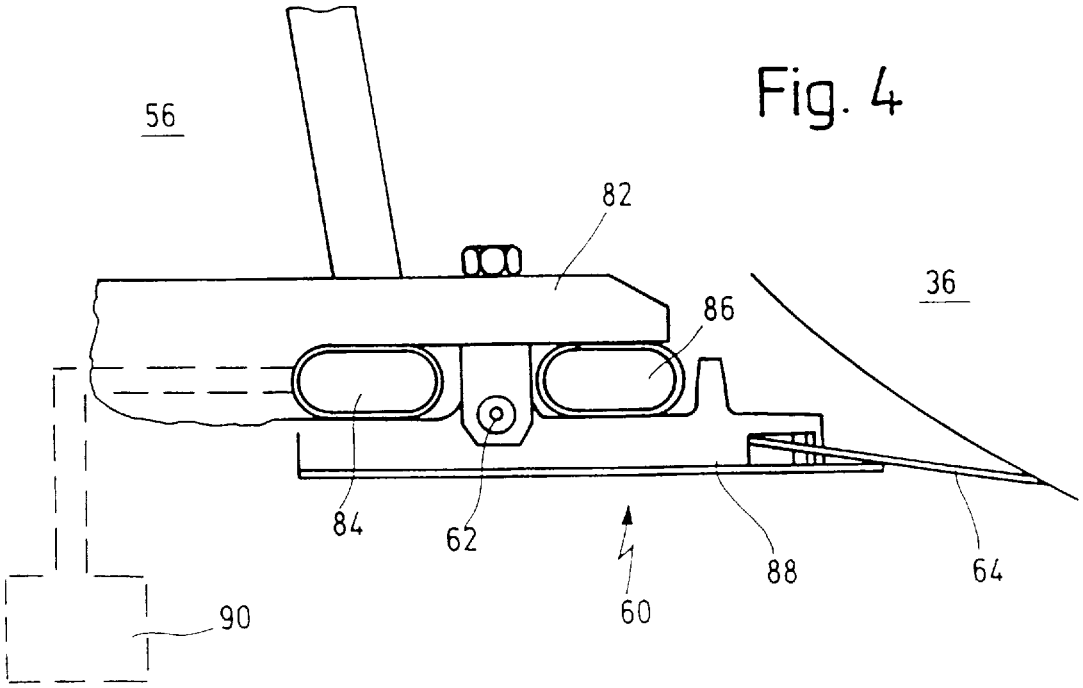
Figure 5:
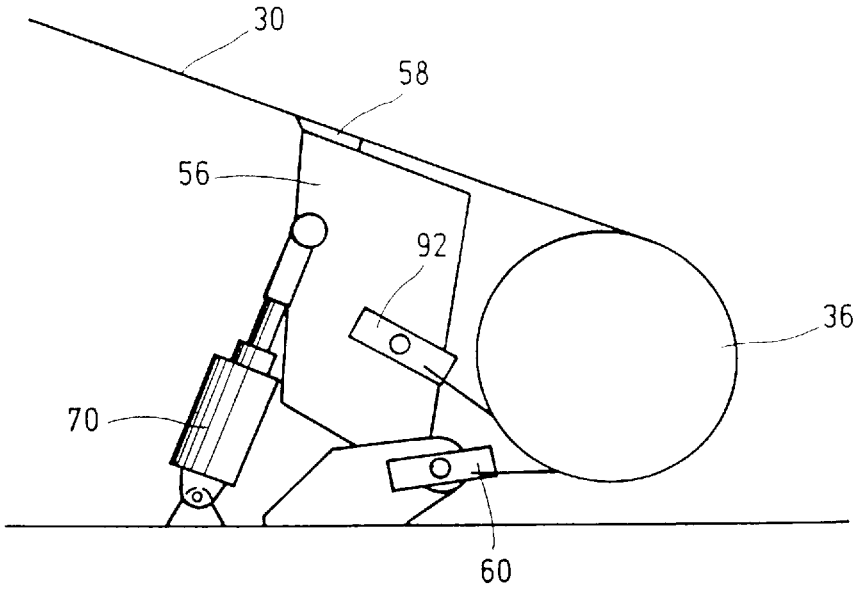

FIG. 4 shows a still further enlarged representation of the second scraper means according to FIG. 3, in engagement with the guide roll; and FIG. 5 shows a schematic representation of an alternative embodiment of a scraper device according to the invention, where two movable scraper means, that can be pivoted into engagement with a guide roll, are provided in addition to a scraper means that acts upon the press felt.

DETAILED DESCRIPTION OF THE PREFERRED EMBODIMENT

Figure 1:
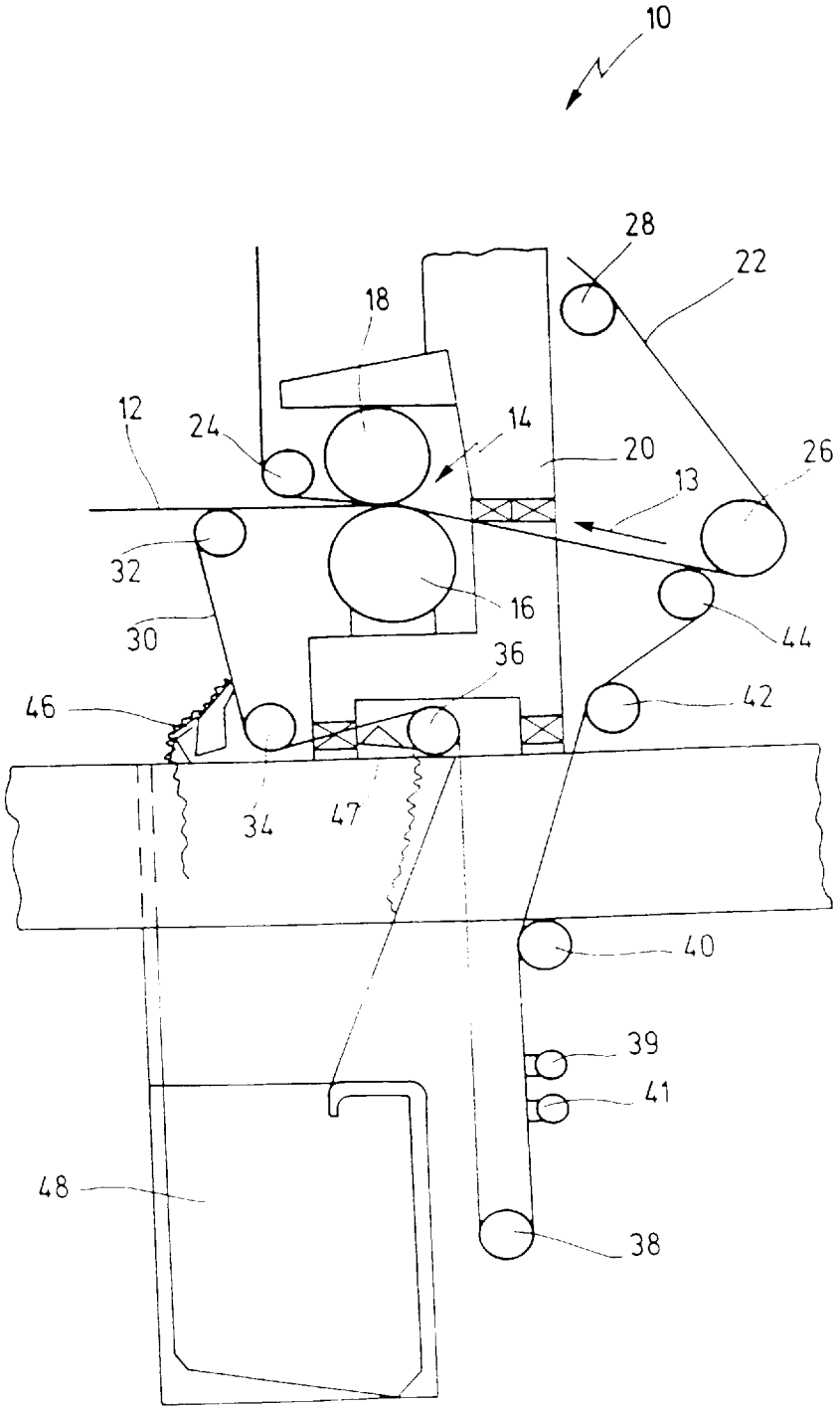
Prior Art Fig. 1
FIG. 1 shows a schematic representation of a detail of the press section of a conventional paper machine.

FIG. 1 shows a detail of a conventional press section, generally indicated by reference numeral 10.

A paper web 12 runs in the direction of arrow 13 through a double-felt press nip 14 with an upper press felt 22 and a lower press felt 30. The press nip 14 is constituted by a lower press roll 16 and an upper back-up roll 18, which are supported on the machine frame 20 in a manner not shown in detail. The endless upper press felt 26 runs around felt guide rolls 24, 26, 28 through the press nip 14 and is deflected at the upper end in a manner not shown in detail. The lower endless press felt 30 runs around felt guide rolls 32, 34, 36, 38, 40, 42, 44.

Following the press nip 14 and before the second felt guide roll 34, a felt scraper 46 is provided on the lower press felt 30. Further, the first outer felt guide roll 36 is equipped with a scraper 47 downstream of the press nip 14.

During normal operation, the felt scraper 46 is pivoted clear of the press felt 30 in order to avoid excessive wear to the press felt 30.

In case of failure, for example when the web breaks, the paper web 12 comes to wrap around the first outer felt guide roll 36, and the paper web residues are removed from the guide roll 36 with the aid of the scraper 47. As soon as possible after the failure has been detected, the felt scraper 46 is also pivoted against the press felt 30, for removing the paper web from the press felt 30. As indicated in FIG. 1, the paper web residues drop into a pulper 48 arranged underneath, which comprises reduction and dissolution means not shown in detail and which serves to dissolve the paper web residues and to return them to the production process.

Due to the fact that during normal productive operation, the felt scraper 46 is positioned clear of the press felt 30, the first outer felt guide roll 36, following the press nip 14, provides the only possibility to remove the paper web from the press felt 30 and, thus, to prevent clogging of the suction tubes 39, 41 arranged downstream thereof.

Figure 2:
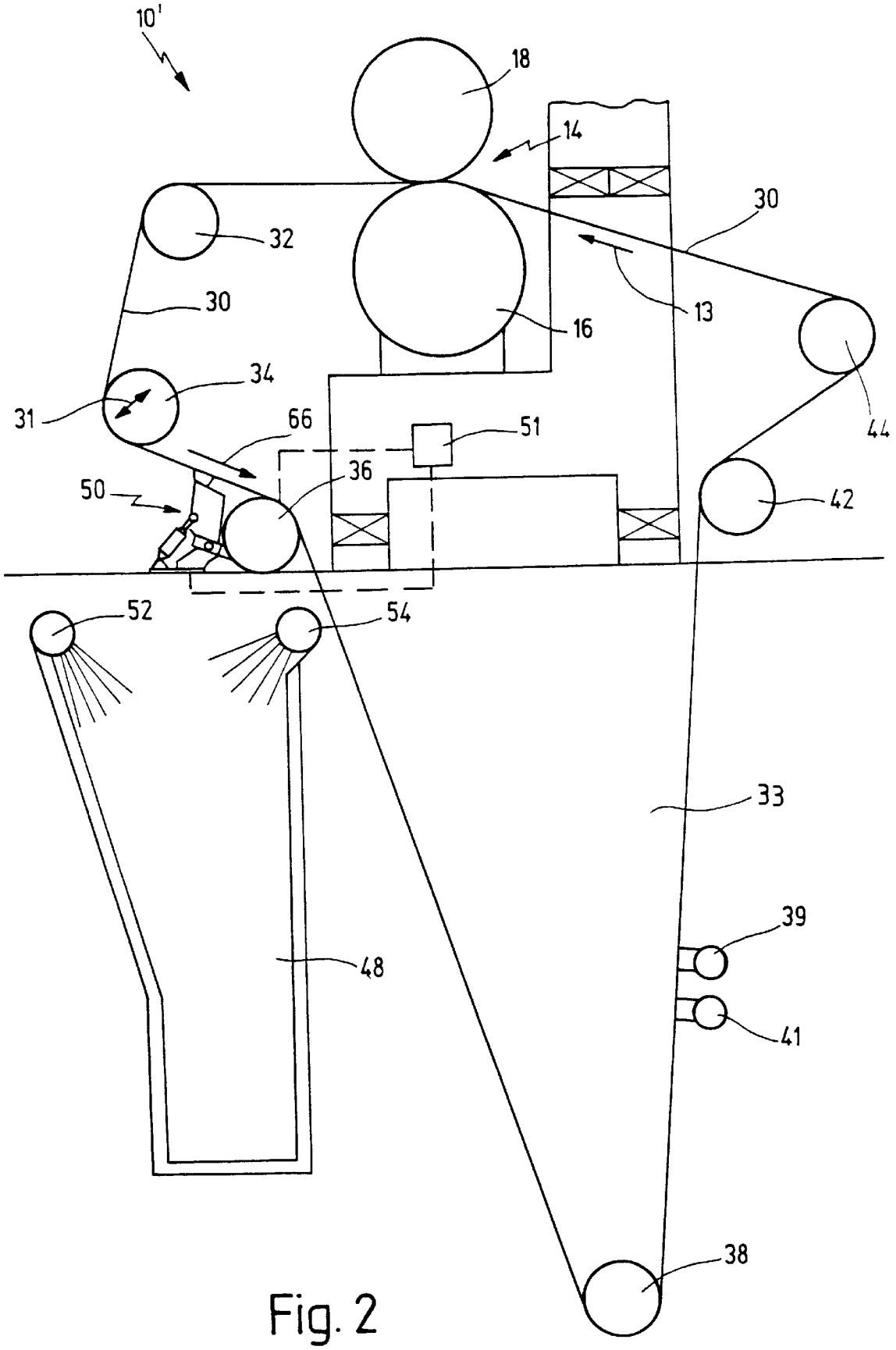
FIG. 2 shows an enlarged exemplary detail, in schematic representation, of a press section according to the invention, illustrating the arrangement of the scraper device according to the invention.

FIG. 2 shows a detail of a press section according to the invention, indicated generally by reference numeral 10'.

In this drawing, identical parts are designated by the same reference numerals as in FIG. 1.

The press shown is again a double-felt press with a press nip 14 formed by a lower press roll 16 and an upper back-up roll 18. The upper press felt has been omitted in the drawing for the sake of clarity.

Following the press nip 14, the lower press felt 30 is first deflected by two inner felt guide rolls 32, 34 and is then guided over an outer felt guide roll 36 which is preceded—viewed in the direction of felt travel 66—by a scraper device 50 according to the invention. At the lower end, the press felt 30 is deflected in upward direction by an inner felt guide roll 38, and is then guided over an outer felt guide roll 42 and an inner felt guide roll 44 back into the press nip 14.

Below the felt guide roll 36 and below the scraper device 50, there can be seen a pulper 48 with reduction and dissolution means not shown in detail, which has additional water jets 52 and 54 arranged at its upper end for assisting the dissolution of the paper web residues so removed from the scraper device 50, and to prevent the paper web residues from sticking to the upper walls of the pulper 48.

The scraper device, indicated generally by reference numeral 50, comprises a first scraper means 58, which is designed as rigid scraper strip made from sintered ceramics or a plastic material and over which the press felt 30 is guided, and a second scraper means 60, which has an elastic blade 64 in engagement with the felt guide roll 36 arranged downstream of the first means, in the direction of felt travel 66.

The scraper device is located outside the loop 33 along which the endless press felt 30 is guided, and is arranged below the press felt 30 in a manner such that there remains a downwardly open free space through which any waste removed is safely carried off even in case of a web failure.

Both scraping means 58, 60 are fixed on a common scraper beam 56, which extends at least over the full width of the paper web, exhibits a cross-sectional shape similar to a parallelogram, and has its lower end pivotally mounted by a longitudinal axis 62 on a carrier 68 fixed to the machine frame 20. The scraper strip 58 is rigidly fixed to the scraper beam 56. The scraper beam 56 can be pivoted by means of a fluid cylinder 70 which has its lower end pivotally mounted on the machine frame 20, via a joint 72, and whose extensible piston 74 is rotatably fixed on the scraper beam 56, via a bracket 75. By extending the piston 74 from the fluid cylinder 70, the scraper strip 58 of the scraper beam 56, therefore, can be pivoted and/or pressed against the press felt 30.

One end of the scraper strip 58 is provided with a stop, indicated schematically by reference numeral 76, which can be adjusted through adjusting means 78. The stop serves for determining the optimum operating position of the scraper beam 56.

At the lower end of the scraper beam 56, the second scraper means 60 with the elastic blade 64 is mounted, so as to pivot about the same longitudinal axis 62, on a carrier plate 82, through which the scraper beam 56 is pivotally mounted on the longitudinal axis 62.

As can be seen in more detail in FIG. 4, the second scraper means 60 comprises a blade carrier 88 which is likewise arranged to pivot about the longitudinal axis 62 and on which the elastic blade 64 is fastened such as to project toward the guide roll 36.

The blade carrier 88 and the carrier plate 82 are spaced one from the other by two pressure hoses 84, 86, a first pressure hose 84 being arranged on the side of the blade carrier 88 facing away from the guide roll 36 and the other pressure hose 86 being arranged on the other side of the longitudinal axis, i.e. on the side facing the guide roll, between the blade carrier 88 and the carrier plate 82 of the scraper beam 56.

The pressure hoses 84 and 86 extend over the full length of the second scraper means 60. When fluid, for example compressed air, is supplied to the pressure hose 84 remote from the guide roll, this causes the elastic blade 64 to be pressed against the guide roll 36 so that any paper residues can be removed from the felt guide roll 38.

If, in contrast, the scraper means 60 is to be lifted off the felt guide roll 36, then the pressure hose 84 is vented, whereas pressure is applied to the pressure hose 86 near the felt guide roll 36, so that the elastic blade 64 is lifted off the felt guide roll 36.

In order to achieve a constant contact pressure between the elastic blade 64 and the surface of the felt guide roll 36, the pressure hose 84 may be additionally connected to an accumulator 90, as indicated schematically in FIG. 4.

In FIG. 3 one can see that the elastic blade 64 of the second scraper means 60 extends on one side of the longitudinal axis 62 toward the felt guide roll 36, while the scraper strip 58 extends on the side of the scraper beam 56 opposite the elastic blade 64. Due to the fact that both scraper means are pivoted at the same pivot point and that the second scraper means 60 has a considerably shorter lever arm than the first scraper means 58, the second scraper means 60 has to compensate, during the pivotal movement of the scraper beam 56, only a short displacement, resulting from the angle of rotation.

Due to the different distances of the scraper strip 58 and the elastic blade 64, respectively, from the longitudinal axis 62, the geometrical arrangement is such that when the scraper strip 58 pivots about an amount a, this causes the elastic blade 64 to perform only a slight pivotal movement, by an amount b, which is approximately one fifth of the amount a.

Consequently, during operation, both scraper means 58, 60 can be brought into engagement with the press felt 30 and/or the press guide roll 36 independently and without great effort.

In the case of an alternative embodiment, the first scraper means 58 is fixed to the stationary scraper beam 56, and a preceding felt guide roll 34, in the direction of felt travel 66, is movable in order to permit the press felt 30 to be pivoted into engagement with the first scraper means 58.

A spray pipe 80 provided on the scraper beam 56 acts to further improve the function of the second scraper means 60, because any paper web residues adhering to the press felt 30 are wetted sufficiently so as to facilitate their removal from the following felt guide roll 36 by the elastic blade 64.

In order to guarantee the reliable removal of any paper web residues from the press felt 30 in the event of web failure, there may be additionally provided an automatic control means 51 which procures that in the case of web failure the first scraper means 58 is automatically pivoted against the press felt 30.

According to an additional further development of that design, the scraper beam 56 may be provided with oscillating engaging means in order to procure an oscillating variation of the contact pressure between the scraper means 58, 60 and the fabric web and/or the guide roll, whereby the risk of marks produced by the scraper means 58, 60 is reduced. Alternatively, one could also think of an oscillating movement of the scraper beam 56 in the direction of its extension, although this would require an additional drive means (not shown).

Another modification of the scraper device according to the invention is depicted schematically in FIG. 5. The difference compared with the design just described consists in that a third scraper means 92 is arranged on the scraper beam 56, in addition to the second scraper means 60, which likewise comprises an elastic blade and may be absolutely identical in structure and function to the second scraper means 60.

As in this case two scraper means 60, 92 act on the felt guide roll 36, one behind the other, the cleaning effect is further improved.

In is understood that in order to achieve an improved cleaning effect, the first scraper means 58 may likewise be coupled, for example, with a second scraper means that engages the press felt 30.

I claim:

1. A scraper assembly for a paper machine comprising a scraper device having a first scraper that extends transversely to the direction of web travel and that can be pivoted into engagement with an unsupported surface of a fabric web guided to travel along an endless loop, and a second scraper that extends transversely to the direction of web travel and can be pivoted into engagement with a guide roll about which the fabric web is guided, wherein the scraper device is arranged outside the loop of the fabric web and can be pivoted into engagement with the fabric web upwardly in such a way that a downwardly open space is left through which any scrap or paper residues removed can be carried off in downward direction under the effect of gravity.

2. The scraper assembly of claim 1, further comprising means for pivoting said scraper device, said means configured and arranged such that said second scraper can be moved upwardly to engage with said guide roll such that a downwardly open space is left through which any scrap removed can be carried off in downward direction under the effect of gravity.

3. The scraper assembly of claim 2, wherein said fabric web is configured as one of a felt, an impermeable cloth and a screen cloth.

4. The scraper assembly of claim 1, wherein both scrapers are mounted on a common scraper beam extending transversely to the direction of web travel.

5. The scraper assembly of claim 4, wherein said scraper beam is arranged stationary, and means is provided for pivoting said first and second scraper into engagement with said fabric web and said guide roll, respectively.

6. The scraper assembly of claim 5, wherein said scraper beam is arranged movably, and at least one of said scrapers comprises means for moving said scraper relative to said scraper beam and to one of said fabric web and said guide roll.

7. The scraper assembly of claim 6, wherein said first scraper is rigidly mounted on said scraper beam, said scraper beam is arranged pivotable about a longitudinal axis extending transversely to the direction of web travel, and said second scraper is arranged pivotably about a longitudinal axis.

8. The scraper assembly of claim 7, wherein said first scraper is fastened on the end of said scraper beam remote from a longitudinal axis about which the scraper beam can pivot, while said second scraper projects from said longitudinal axis in opposite direction.

9. The scraper assembly of claim 8, wherein said scraper strip and said second scraper are configured and arranged such that said scraper strip gets into contact with the fabric web earlier, viewed in the direction of travel, than said second scraper with said guide roll.

10. The scraper assembly of claim 8, wherein said scraper strip is made from sintered ceramics or a plastic material.

11. The scraper assembly of claim 4, wherein said second scraper comprises a blade carrier, that can pivot about a longitudinal axis relative to said scraper beam and on which a scraper blade is mounted, and wherein a pressure body, extending in the longitudinal direction of said scraper blade, is arranged on each side of the longitudinal axis, between said scraper beam and said blade carrier, thereby allowing to elastically press said scraper blade against said guide roll, or to lift said scraper blade off said guide roll, depending on the pressure exerted upon said pressure bodies.

12. The scraper assembly of claim 11, wherein the pressure body, that faces away from the guide roll is connected to a pressure reservoir.

13. The scraper assembly of claim 4, comprising a spray pipe arranged on said scraper beam.

14. The scraper assembly of claim 4, wherein said common scraper beam, extending transversely to the direction of web travel, is configured and arranged to allow an oscillating movement.

15. The scraper assembly of claim 1, wherein said first scraper is configured as a scraper strip for cleaning said fabric web, and said second scraper comprises a thin, elastic blade for cleaning said guide roll provided outside said loop of said fabric web.

16. The scraper assembly of claim 1, comprising a stop arranged stationary for limiting a pivoting movement of said scraper beam.

17. The scraper assembly of claim 16, wherein said stop is adjustable.

18. The scraper assembly of claim 1, comprising wetting and reduction means, wherein said first and second scraper are arranged relative to each other and with respect to said wetting and reduction means such that any paper web residues scraped off can drop into said wetting and reduction means.

19. The scraper assembly of claim 18, wherein said wetting and reduction means comprise water jets for wetting or reducing the paper web residues.

20. The scraper assembly of claim 1, wherein said guide roll located within said loop upstream of said first scraper, viewed in the direction of web travel, is configured and arranged in such a way that, when the paper web winds around the guide roll, any parts of the paper web fall past said scraper beam and into a common wetting and reduction means arranged underneath.

21. The scraper assembly of claim 1, wherein said guide roll is arranged upstream of said first scraper, in the direction of felt travel, and is arranged movably to allow pressing of said fabric web against said first scraper.

22. The scraper assembly of claim 1, wherein automatic control means are provided for bringing said first scraper into contact with said fabric web in case of failure of the web.

23. An apparatus for a paper machine that includes a fabric web formed as an endless loop guided around guide roll, the apparatus comprising:

a scraper device comprising:

a first scraper that extends transversely to a direction of web travel and that is pivotably movable into contact with an unsupported surface of the fabric web; and a second scraper that extends transversely to the direction of web travel and that is pivotably movable into contact with the guide roll; and the scraper device being located outside the loop of the fabric web in such a way that a downwardly open space is left through which any scrap or paper residues removed can be carried off in downward direction under the effect of gravity.

24. The apparatus of claim 23, further comprising a pivoting device coupled to said scraper device, said pivoting device being adapted to move the second scraper upwardly to contact said guide roll.

25. The apparatus of claim 24, said fabric web comprising one of a press felt, an impermeable cloth, and a screen cloth.

26. The apparatus of claim 23, further comprising a scraper beam that extends transversely to the web travel direction; and the first and second scrapers being mounted on said scraper beam.

27. The apparatus of claim 26, said scraper beam being mounted to be stationary; and pivoting devices for said first and second scrapers are coupled to said scraper beam.

28. The apparatus of claim 27, said scraper beam being movably mounted, and the apparatus further comprising:

a device for moving at least one of said first and second scraper relative to said scraper beam and to a respective at least one of said fabric web and said guide roll.

29. The apparatus of claim 28, said first scraper being rigidly mounted to said scraper beam, said scraper beam being pivotably movable about a longitudinal axis extending transversely to the direction of web travel, and said second scraper being pivotably movable about the longitudinal axis.

30. The apparatus of claim 29, said first scraper being coupled to an end of said scraper beam remote from the longitudinal axis; and said second scraper projecting from said longitudinal axis in direction opposite said first scraper.

31. The apparatus of claim 23, said first scraper being composed of a scraper strip for cleaning said fabric web, and said second scraper being composed of a thin, elastic blade for cleaning said guide roll in a region outside said endless loop of said fabric web.

32. The apparatus of claim 31, said scraper strip and said second scraper are positioned so that said scraper strip contacts the fabric web before, relative to the web travel direction, said second scraper contacts said guide roll.

33. The apparatus of claim 23, further comprising wetting and reduction devices adapted to receive scrap and residue removed by the scraper device.

34. The apparatus of claim 33, said wetting and reduction device comprising water jets for one of wetting and reducing the paper web residues.

35. The apparatus of claim 23, further comprising an automatic control to bring said first scraper into contact with said fabric web in response to failure of the web.

* * * * *